United States Patent [19]

Barrett et al.

[11] Patent Number: 4,554,738

[45] Date of Patent: Nov. 26, 1985

[54] APPARATUS FOR SUPPORTING AND GUIDING MACHINE FOR OPERATING ON SHEET MATERIAL SUCH AS CLOTH

[75] Inventors: Robert C. Barrett, Angola; John H. Buscher, East Amherst; William M. Putnam, Buffalo, all of N.Y.

[73] Assignee: Eastman Machine Company, Buffalo, N.Y.

[21] Appl. No.: 532,288

[22] Filed: Sep. 15, 1983

[51] Int. Cl.[4] ..... B26B 7/00

[52] U.S. Cl. ..... 30/275; 83/925 CC; 414/749

[58] Field of Search ..... 30/273-275; 83/925 CC; 901/1, 6, 14, 41, 50; 414/749

[56] References Cited

U.S. PATENT DOCUMENTS

| | | | |
|---|---|---|---|
| 130,344 | 8/1872 | Warth | 30/273 X |
| 151,456 | 5/1874 | Warth | 30/275 X |
| 3,606,162 | 9/1971 | Lehmann | 901/50 X |
| 3,991,706 | 11/1976 | Pearl | 83/925 CC X |
| 4,403,416 | 9/1983 | Adachi | 83/925 CC X |

*Primary Examiner*—Douglas D. Watts

*Attorney, Agent, or Firm*—Christel, Bean & Linihan

[57] ABSTRACT

Apparatus for supporting and guiding a machine for operating on sheet material such as cloth while the material lies on a surface of a supporting structure having a pair of substantially parallel sides extending lengthwise of the structure, the apparatus comprising a carriage adapted for movement lengthwise of the supporting structure along a path substantially parallel to the sides, a guide arm on the carriage extending across the supporting surface between the sides and spaced from the surface, and a support arm connected to the guide arm extending at an angle thereto and located in spaced relation to the supporting surface, the support arm carrying at one end a machine for operating on the sheet material, and the support arm being pivotally movable about an axis substantially parallel to the longitudinal axis of the guide arm and along a plane disposed substantially perpendicular to the supporting surface. The support arm also is movable longitudinally along the guide arm and also is pivotally movable about an axis substantially perpendicular to the longitudinal axis of the guide arm. The support arm extends crosswise of the support arm and carries a balancing weight on the other end, and the balancing weight can be provided by another machine carried on that end of the arm. The machine can be provided with an improved supporting base characterized by a sheet of resilient material such as spring metal having an intermediate portion shaped to be spaced from the supporting surface, a leading edge portion contacting the surface and a trailing edge portion shaped to facilitate movement of the resilient sheet over and along the work surface.

37 Claims, 18 Drawing Figures

Fig. 3.
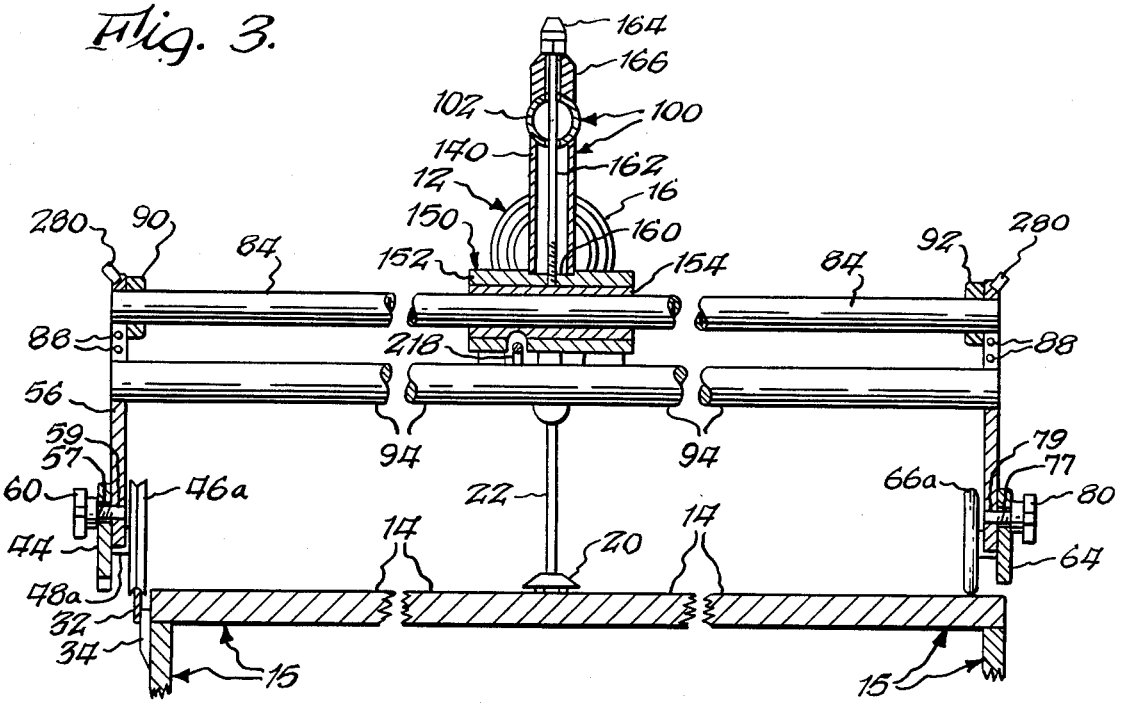
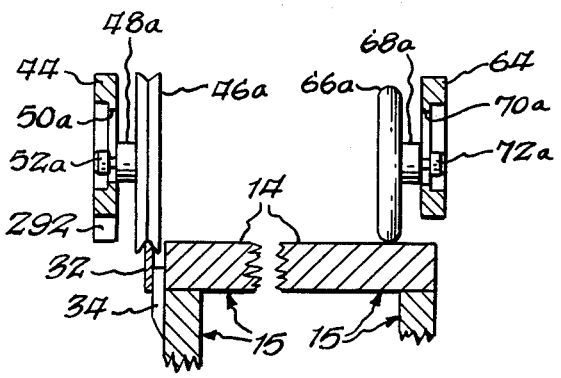
Fig. 4.
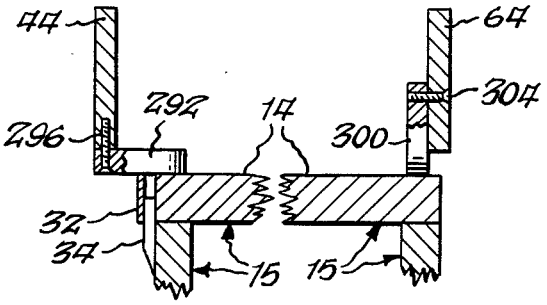
Fig. 5.
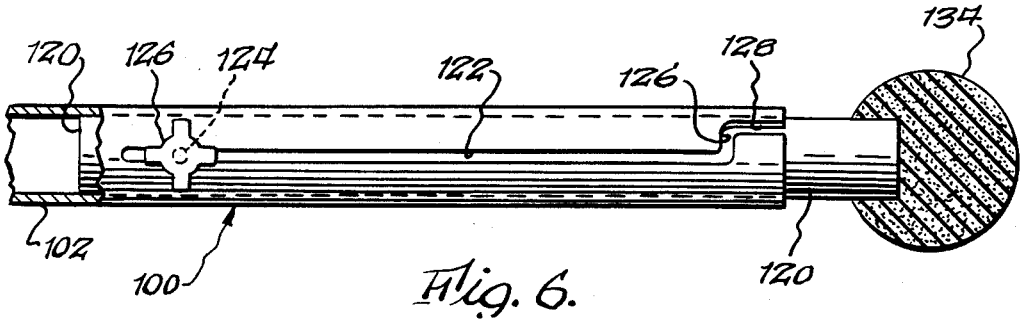
Fig. 6.

Fig. 7.
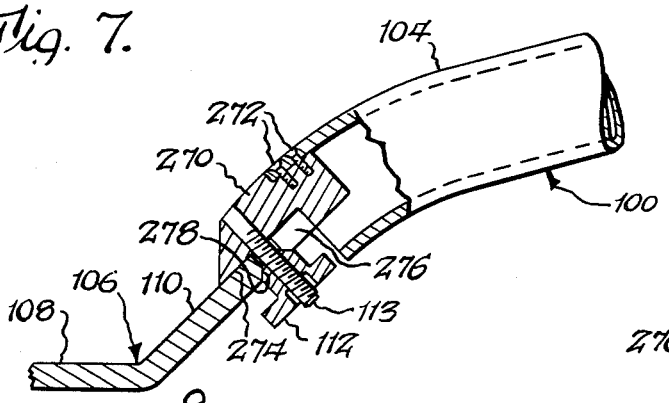
Fig. 7a.
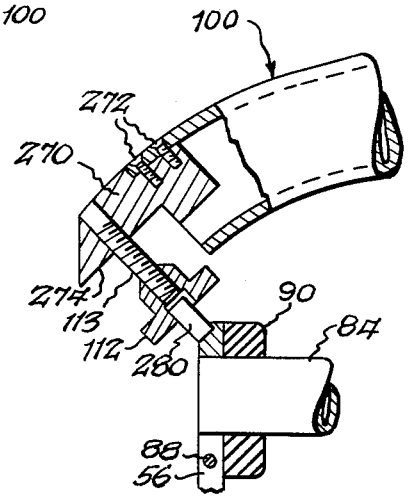
Fig. 8.
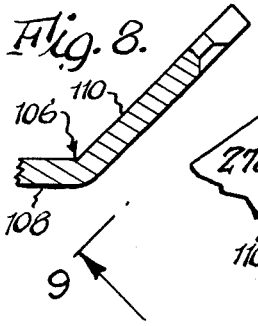
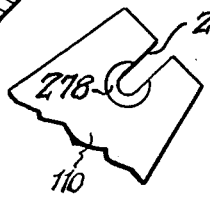
Fig. 9.
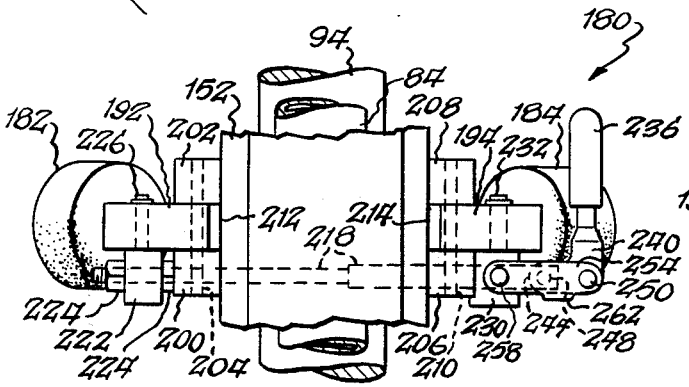
Fig. 12.
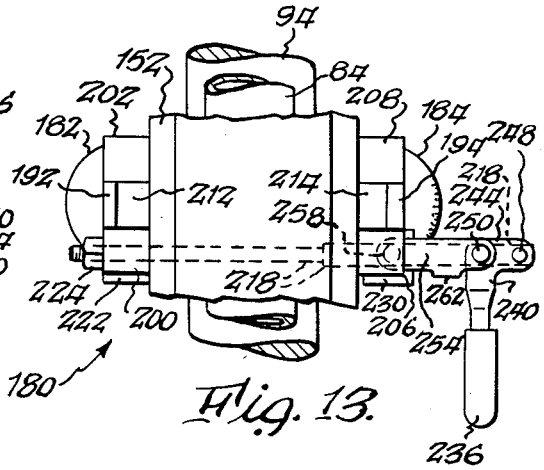
Fig. 13.
Fig. 10.
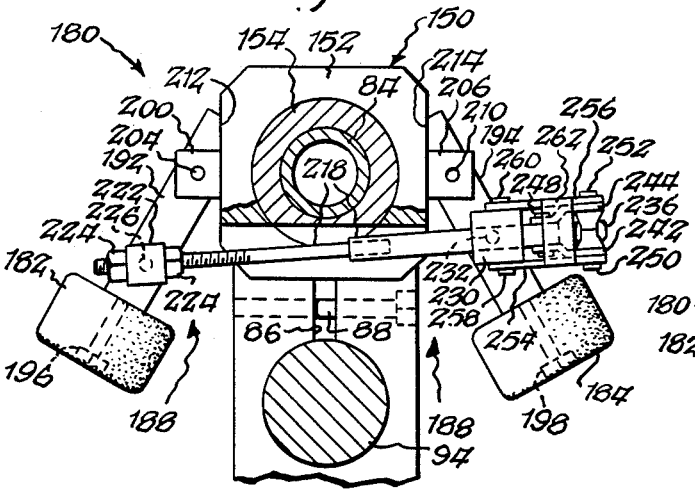
Fig. 11.
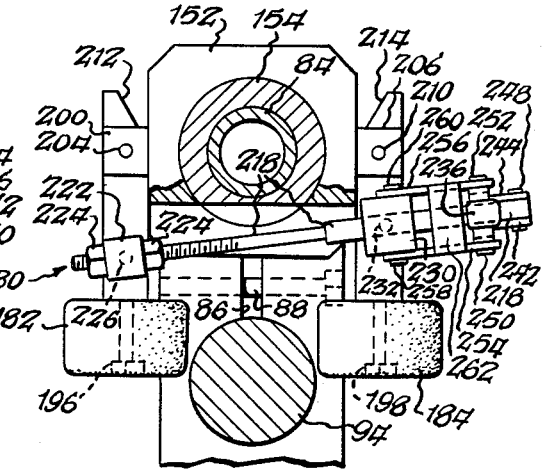

Fig. 14.
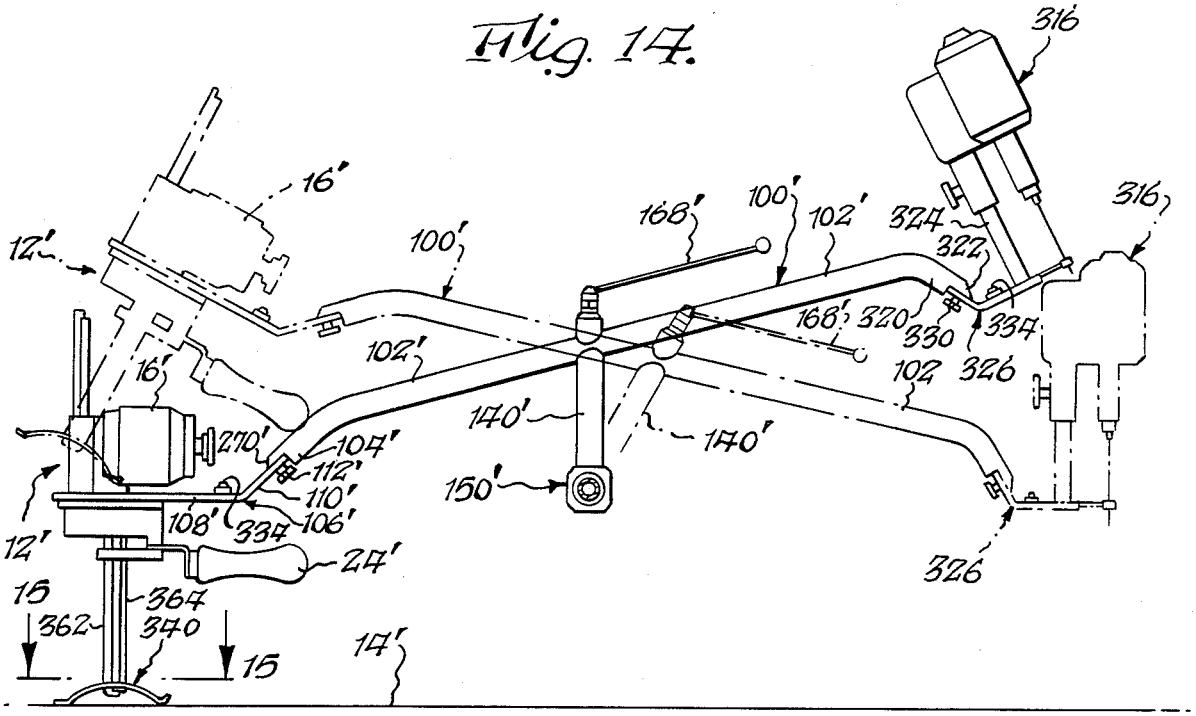
Fig. 15.
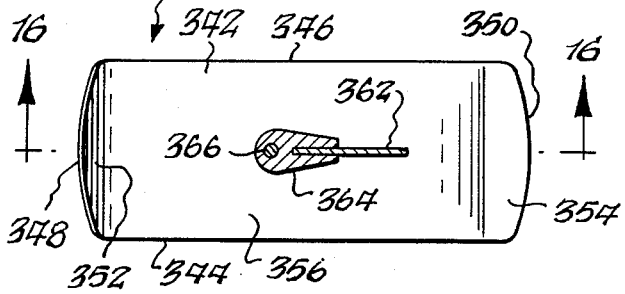
Fig. 16.
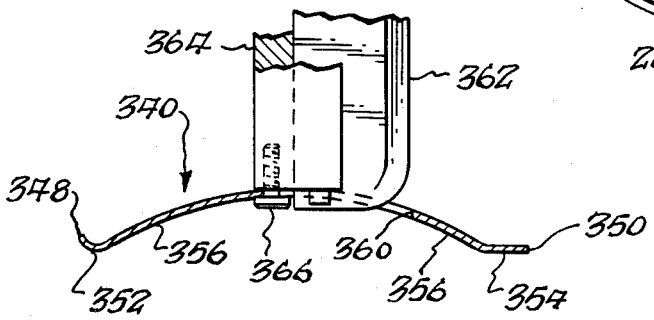
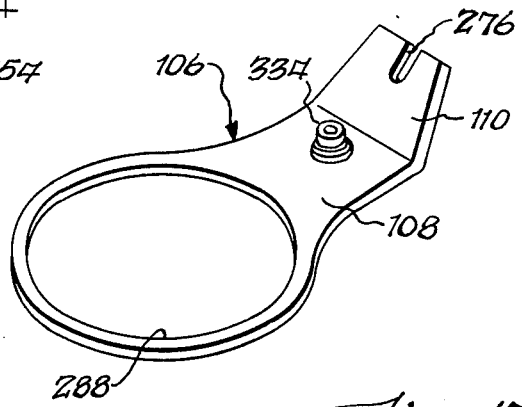
Fig. 17.

APPARATUS FOR SUPPORTING AND GUIDING MACHINE FOR OPERATING ON SHEET MATERIAL SUCH AS CLOTH

BACKGROUND OF THE INVENTION

This invention relates to the art of machines for performing operations such as cutting, drilling and marking sheet material such as cloth, and more particularly to a new and improved apparatus for supporting and guiding such machines.

One area of use of the present invention is in cutting, drilling and marking cloth while supported on the surface of a table, although the principles of the present invention can be variously applied. In the past, machines for cutting, drilling and marking sheet material such as cloth were pushed and guided by hand over and along the work to perform such operations. This was physically exhausting for the workers due to the heavy weight of such machines. Also, such machines have a rather large base for support and stability which, in turn, limits maneuverability and the ability to operate along rather difficult or complex patterns.

Relatively recently mechanical arrangements have been proposed for supporting and guiding these machines which arrangements include a carriage movable along the work table and an arm connected at one end to the carriage and carrying the machine at the other end. Such arrangements are very bulky and heavy making them difficult to move or transport between different work tables and factory locations. The heavy weight also can contribute undesirable resistance to machine movement while operations are being performed. Such arrangements also often require that the machine be removed from the arm to allow even routine maintenance operations and change or replacement of cutting blades, drill bits and the like.

SUMMARY OF THE INVENTION

It is, therefore, a primary object of this invention to provide a new and improved apparatus for supporting and guiding a machine for operating on sheet material such as cloth placed on a supporting surface.

It is a further object of this invention to provide such apparatus which is relatively light in weight so as to be convenient and easy to use, maintain and transport.

It is a further object of this invention to provide such apparatus which promotes consistent accuracy in the operations performed by the machine on sheet material.

It is a further object of this invention to provide such apparatus which affords a high degree of mobility to the machine in movement over and along the sheet material.

it is a further object of this invention to provide such apparatus which allows the user to control the amount of operating machine weight on the supporting surface.

It is a further object of this invention to provide such apparatus which reduces resistance to movement of the machine as it operates on the sheet material.

It is a further object of this invention to provide such apparatus which reduces friction during operation of the machine on the sheet material.

It is a further object of this invention to provide such apparatus which allows maintenance operations and changing to tools to be performed on the machine while connected to the apparatus.

It is a further object of this invention to provide such apparatus which is readily useable by human operators having a relatively low lever of operating experience.

It is a further object of this invention to provide such apparatus which is readily useable on existing work tables and sheet material supporting surfaces.

The present invention provides apparatus for supporting and guiding a machine for operating on sheet material such as cloth while the material lies on a surface of a supporting structure having a pair of substantially parallel sides extending lengthwise of the structure, the apparatus comprising carriage means adapted for movement lengthwise of the supporting structure along a path substantially parallel to the sides, a guide arm on the carriage means extending across the supporting surface between the sides and spaced from the surface, and a support arm connected to the guide arm extending at an angle thereto and located in spaced relation to the supporting surface, the support arm carrying at one end a machine for operating on the sheet material, and the support arm being pivotally movable about an axis substantially parallel to the longitudinal axis of the guide arm and along a plane disposed substantially perpendicular to the supporting surface. The support arm also is movable longitudinally along the guide arm and also is pivotally movable about an axis substantially perpendicular to the longitudinal axis of the guide arm. The support arm extends crosswise of the support arm and carries a balancing weight on the other end, and the balancing weight can be provided by another machine carried on that end of the arm. The machine can be provided with an improved supporting base characterized by a sheet of resilient material such as spring metal having an intermediate portion shaped to be spaced from the work surface, a leading edge portion contacting the surface and a trailing edge portion shaped to facilitate movement of the resilient sheet over and along the surface.

The foregoing and additional advantages and characterizing features of the present invention will become clearly apparent from a reading of the ensuing detailed description together with the included drawing wherein:

BRIEF DESCRIPTION OF THE DRAWING FIGURES

FIG. 3 is a sectional view taken about on line 3—3 in FIG. 1;

FIG. 4 is a fragmentary sectional view taken about on line 4—4 in FIG. 1;

FIG. 5 is a fragmentary sectional view taken about on line 5—5 in FIG. 1;

FIG. 6 is a fragmentary elevational view, partly in section, taken about on line 6—6 in FIG. 2;

FIG. 7 is a fragmentary sectional view taken about on line 7—7 in FIG. 1 and showing a yoke connected to the end of the support arm of the apparatus;

Figure 2:
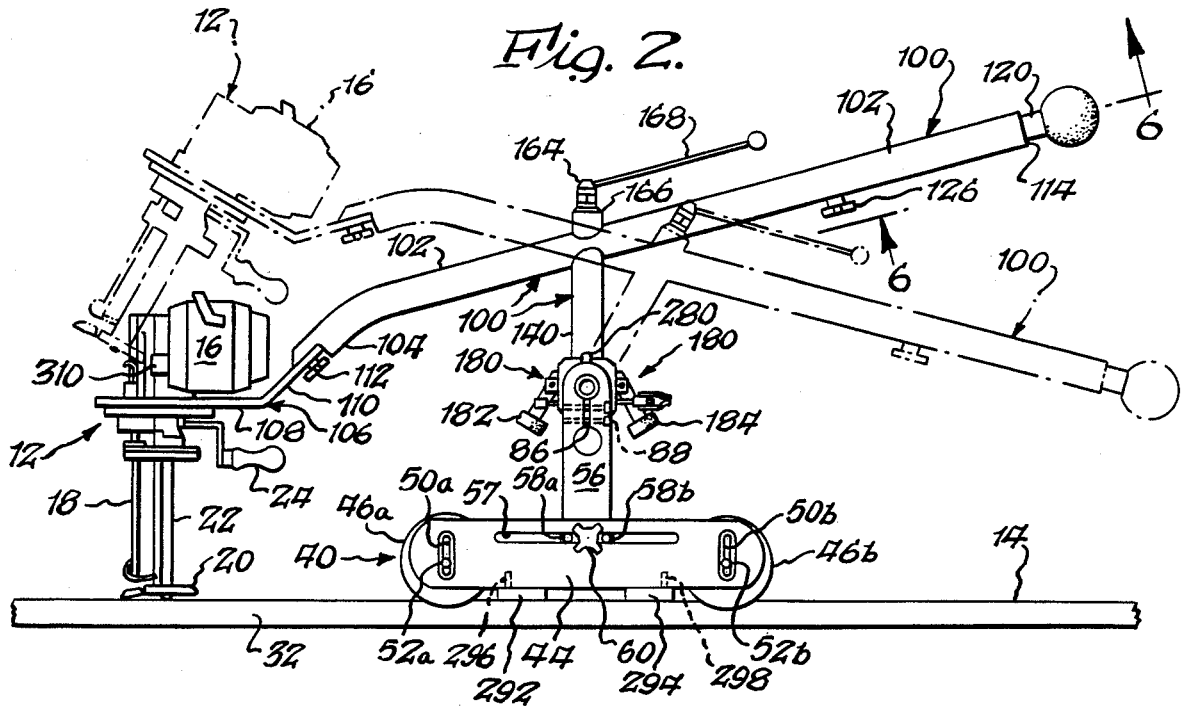
FIG. 2 is a side elevational view of the apparatus of FIG. 1.

FIG. 7*a* is a view similar to FIG. 7 with the yoke disconnected from the support arm and showing a connection of the end of the support arm to an end of the guide arm to facilitate transportation of the apparatus;

FIG. 8 is a fragmentary view of the yoke shown in FIG. 7 disconnected from the support arm;

FIG. 9 is a fragmentary elevational view taken about on line 9—9 in FIG. 8;

FIG. 10 is a fragmentary side elevational view, partly in section, of the holding means including toggle mechanism shown in an open position;

FIG. 11 is a view similar to FIG. 10 but showing the mechanism in a closed position;

FIG. 12 is a fragmentary top plan view of the arrangement of FIG. 10;

FIG. 13 is a fragmentary top plan view of the arrangement of FIG. 11;

FIG. 14 is a fragmentary side elevational view, similar to FIG. 2, showing a modification of the apparatus of the present invention;

FIG. 15 is a plan view taken about on line 15—15 in FIG. 14.

FIG. 16 is a sectional view taken about on line 16—16 in FIG. 15; and

FIG. 17 is a perspective view of a yoke for connecting a machine to the support arm of the apparatus.

DETAILED DESCRIPTION OF THE ILLUSTRATED EMBODIMENTS

Referring now to FIGS. 1–4, there is shown apparatus generally designated 10 according to the present invention for supporting and guiding a machine 12 for operating on sheet material such as cloth while the material lies on a surface 14 of a supporting structure generally designated 15. In the illustrative apparatus shown, machine 12 is a cloth cutting machine in the form of a straight knife machine having, briefly, a motor 16, cutting blade 18, supporting base 20, supporting frame 22 and handle 24. By way of example, in an illustrative apparatus, machine 12 can be a straight knife machine commercially available from Eastman Machine Company under the designation Blue Streak II Model 629. Other machines can of course be used, for example marking machines such as cloth drills and hot notchers.

Supporting surface 14 typically is the top surface of a cutting room table which is fairly wide, for example typically about 6 ft. wide, and extremely long, in some instances as long as 100 ft. The section of surface 14 shown extends lengthwise between the left and right hand portions of FIGS. 1 and 2 and is bounded by a pair of substantially parallel sides 26 and 28. Surface 14 is provided with guide means generally designated 30 extending lengthwise thereof for a purpose to be described. In the arrangement shown, the guide means comprises a rail or track in the form of a relatively thin metal strip 32 extending lengthwise of surface 14 along side 26 and is secured to the supporting structure by fasteners designated 34. In the arrangement shown, the track is provided only adjacent one side 26, and a portion of the surface 14 adjacent the opposite side 28 serves as the other guide means. Alternative arrangements can of course be employed, such as having another track similar to strip 32 fastened along side surface 28 or having one or both tracks provided on the surface 14 adjacent the sides thereof.

The apparatus of the present invention comprises carriage means adapted for movement lengthwise of the supporting structure 15 and surface 14 thereof during use along a path substantially parallel to the sides 26,28. In the apparatus shown, the carriage means comprises a frame extending lengthwise of the supporting structure 15 and a pair of wheels rotatably connected to the frame at spaced locations along the length thereof. In particular, the carriage means comprises a pair of components generally designated 40 and 42 each adjacent a corresponding one of the sides 26 and 28, respectively, and each component including a frame and wheels. As shown in FIGS. 1–4 carriage component 40 includes a planar, elongated main frame portion 44 and a pair of wheels 46*a*,46*b* rotatably connected to frame portion 44 at spaced locations along the longitudinal axis thereof and near the opposite ends thereof. As shown in more detail in FIG. 4, the axle of each wheel 46*a* and 46*b* is journalled in a bearing 48*a* and 48*b*, respectively, which, in turn, is connected to frame 44. In addition, the connection of the bearing to the frame is adjustable permitting selective adjustment of the rotational axis of the wheel in a direction perpendicular to the supporting surface 14 when the apparatus is in a position of use. This is accomplished by the provision of slots 50*a*,50*b* in the frame 44 disposed perpendicular to the longitudinal axis thereof and hence perpendicular to surface 14. Adjustment screws 52*a* and 52*b* extend through the slots 50*a* and 50*b*, respectively, with the heads thereof engaging portions of the slot. Each wheel 46*a*,46*b* has a grooved peripheral surface to facilitate engagement with the edge of track 32 as shown in FIGS. 3 and 4.

Carriage component 40 also includes a planar, elongated upstanding frame portion 56 disposed substantially peripendicular to the longitudinal axis of the main frame portion 44 and likewise substantially perpendicular to the supporting surface 14. Frame portion 56 is connected near the lower end thereof to frame portion 44 and in an adjustable manner allowing movement in a direction longitudinally of frame 44. This is accomplished by provision of an elongated, longitudinally extending slot 57 in frame portion 44, a pair of spaced-apart roller bearings 58*a*,58*b* fixed to frame portion 56 and extend through slot 57 in sliding or rolling relation with the opposed edges of slot 57, a rod 59 fixed to frame portion 56 between bearings 58*a*,58*b* and extending through and beyond slot 57, and a knob 60 threaded on the end of rod 59 and engaging the outer surface of frame 44 adjacent the edges of slot 57. When knob 60 is tightened by hand, bearings 58*a*,58*b* and rod 59 provide a three point connection of frame portions 44,56. When knob 60 is loosened the point of connection is adjustably movable, being guided by bearings 58*a*,58*b* moving along slot 57, whereupon the new, adjusted point of connection is secured by tightening knob 60.

Carriage component 42 is substantially identical to component 40 and includes an elongated main frame portion 64, wheels 66*a* and 66*b* rotatably connected thereto by means of bearings 68*a* and 68*b*, respectively. The wheels likewise are vertically adjustable by means of adjustment slots, one designated 70*a* in FIG. 4, cooperating with adjusting screws such as the one designated 72*a* in FIG. 4. Wheels 66*a*,66*b* have convex peripheral surfaces since they travel on the supporting surface 14. There is also provided an upstanding frame portion 76 connected to the main frame portion 64. It is adjustably connected to frame portion 64 for movement longitudinally of frame 64 in a manner like that of frame portions 44,56 by means of an elongated slot 77 in body 64 through which spaced-apart roller bearings (not shown) extend in a manner like bearings 58*a*,58*b* in slot 57, and a rod 79 onto which a knob 80 is threaded.

Figure 1:
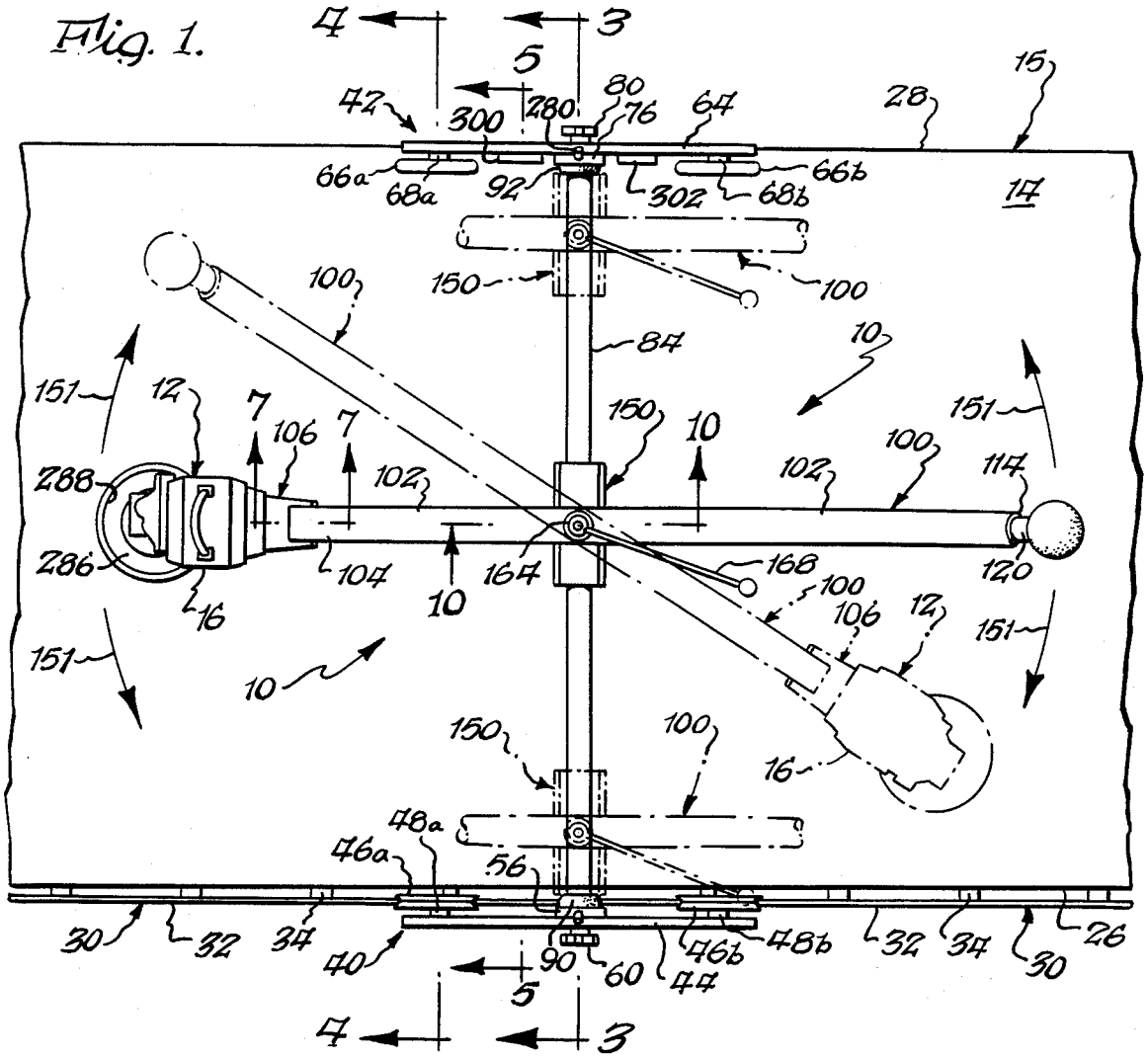
FIG. 1 is a top plan view of the apparatus of the present invention as it would appear in use supporting and guiding a machine for operating on sheet material such as cloth while the material lies on a supporting surface.

The apparatus of the present invention further comprises a guide arm 84 having a longitudinal axis and carried by the carriage means and extending in a direction across the surface 14 and between the sides 26,28 and located in spaced relation to the supporting surface 14 when the apparatus is in use. As shown in FIGS. 1–3, the guide arm 84 is in the form of a hollow tube connected at each end to corresponding ones of the carriage upstanding frame portions 56 and 76. Tube 84 preferably is of stainless steel to provide a smooth outer surface for a purpose to be described. Tube 84 is removably connected to the carriage frame portions 56,76 in the following manner. The ends of tube 84 are relatively snugly but removably received in circular openings provided in frame portions 56,76. Each frame portion, as shown in FIG. 2, has a relatively short, longitudinally extending slot 86 leading from the edge of the circular opening, and tightening and loosening of the connection is provided by fasteners 88. Tube 84 also is fitted with a pair of shock absorbing elements 90,92 on each end adjacent the connection to the carriage frame portions 56,76. Elements 90,92 are generally ring-shaped and of rubber, synthetic or other suitable material having shock absorbing capability for a purpose to be described.

The apparatus of the present invention also includes an auxiliary arm 94 having a longitudinal axis and carried by the carriage means and extending substantially parallel to the guide arm 84 for a purpose which will be described. As shown in FIGS. 2 and 3, auxiliary arm 94 is located near guide arm 84 and between guide arm 84 and surface 14. In the arrangement shown, the longitudinal axes of guide arm 84 and auxiliary arm 94 are substantially in the same plane, which, in turn, is disposed substantially perpendicular to surface 14. Auxiliary arm 94 also is in the form of a hollow tube and is connected at opposite ends to corresponding ones of the frame parts 56,76 and also can be removed therefrom by the provision of slots 86 and fasteners 88 as previously described.

The apparatus of the present invention further comprises a support arm generally designated 100 extending at an angle to guide arm 84 and located in spaced relation to the supporting surface 14. Support arm 100 is in the form of a hollow, elongated tube including a main portion 102 having a longitudinal axis. The support arm 100 includes means at one end thereof, i.e. the left-hand end as viewed in FIGS. 1 and 2, for carrying a machine for operating on sheet material lying on surface 14, i.e., the machine 12 shown in FIGS. 1–3. In particular, arm 100 is provided with a relatively short end section 104 dispoed at an angle to the main portion 102. Connection between machine 12 and arm portion 104 is provided by a yoke generally designated 106 having a first planar portion 108 rotatably connected to machine 12 and a second portion 110 disposed at an angle to portion 102 and releasably connected to the arm end section 104 by means of a knob 112 threaded on a rod 113. The support arm 100 extends crosswise of the guide arm 84 as shown in FIGS. 1 and 2, and terminates in another end designated 114 opposite the end carrying the machine 12. The two ends of support arm 100 thus are located on opposite sides of and spaced from guide arm 84. A weight is carried on the other end 114 for balancing the weight of machine 12 during pivotal movement of support arm 100 along a plane generally perpendicular to surface 14 in a manner which will be described. One form of the weight is a heavy metal cylinder 120, for example of cast iron, which is telescopingly received in the tubular arm 100. As shown in FIG. 6, the effect of weight 120 can be adjustable by being slidably carried on the end of the support arm 100 and provided with releasable means for selectably fixing the location of weight 120 on arm 100 thereby permitting adjustment thereof. In particular, such adjustment is provided by cooperation between a slot 122 extending longitudinally along the end of tube 100, a threaded rod 124 extending from weight 120 through the slot and a knob 126 threaded onto rod 124. Slot 122 has an offset portion 128 and an exit portion 130 to prevent accidental or inadvertent movement of the weight from the tube 100. In addition, weight 120 is provided with a protective element 134 of soft material such as rubber in the event that it is moved inadvertently in contact with persons or structures near the apparatus. Moving weight 120 along tube 100 changes the influence of the weight on machine 12 taking into account the moment arm associated with the pivotal connection of support arm 100 to guide arm 84 in a manner which will be described. The magnitude of the weight is selected to be about equal to or less than the weight of the machine carried at the other end of arm 100, and a typical machine, for example the straight knife machine shown in FIGS. 1 and 2, often weighs in the neighborhood of 35 lbs.

Support arm 100 has a relatively short branch portion 140 which extends from the main portion 102 as shown in FIGS. 2 and 3. The distance between the junction of portions 140 and 102 and the end carrying machine 12 is shorter than the distance between that junction and the opposite end 114. In particular the junction is located at about $\frac{1}{3}$ the length of arm 100 proceeding from the end containing machine 12 to the opposite end. The branch 140 defines an acute angle with the section of arm 100 leading to machine 12, for example an angle of about 75°. Therefore, when arm 100 is in the solid line postion illustrated in FIG. 2, i.e. with branch 140 disposed substantially perpendicular to surface 114 with machine 12 containing surface 14 as shown, the main portion 102 defines an angle of about 15° with surface 14. These angles and location of the junction together with the length of portion 114 are subject to variation depending upon the nature of the machine carried by arm 100 and the desired effect on the machine to be provided by the arm 100 and the weight carried thereby.

The apparatus of the present invention further comprises means generally designated 150 for connecting the support arm 100 to the guide arm 84. The connecting means 150 provides for pivotal movement of support arm 100 about an axis substantially parallel to the longitudinal axis of guide arm 84 and along a plane disposed substantially perpendicular to supporting surface 14. This pivotal movement is illustrated by the solid and broken line positions of arm 100 shown in FIG. 2. The connecting means 150 also provides longitudinal movement of support arm 100 along the guide arm 84. This is illustrated by the solid line position of support arm 100 in FIG. 2 at about the mid point along tube 84 and by the two broken line and fragmentary showings of arm 100 and connecting means 150 in FIG. 2 after having been moved longitudinally along guide arm 84 in either direction to locations adjacent the opposite ends of arm 84. Connecting means 150 also provides pivotal movement of support arm 100 about an axis substantially perpendicular to the longitudinal axis of guide arm 84. This is in the directions indicated by arrows 151 and further shown by the solid line position of arm 100 in FIG. 1 and the broken line position where it has been rotated about the afore-mentioned axis through almost 180°.

Connecting means 150 is in the form of a linear bearing structure having an outer body 152 which is generally solid rectangular in shape and having an inner bearing structure 154 as shown in FIG. 3 which provides rotatable and slidable contact with the guide tube 84. The inner bearing structure 154 has a circular inner surface in bearing contact with the outer surface of tube 84. This can be provided by various bearing arrangements, for example a plurality of annular races of ball bearings at spaced locations along the longitudinal axis of the structure 150, with the ball bearings contacting the smooth outer surface of guide tube 84. The rotatable connection of structure 150 on tube 84 provides the pivotal movement of arm 100 in the plane perpendicular to surface 14 as shown in FIG. 2. The apparatus also includes means for holding the connecting means 150 and hence arm 100 at a selected rotational position about tube 84 and for limiting the degree of rotation and hence the pivotal movement of arm 100, all of which will be described in detail presently. The bearing contact between structure 150 and the outer surface of tube 84 also provides slidable movement along tube 84 and hence the longiudinal movement of arm 100 along tube 84 as shown in FIG. 1. The bumpers 90,94 at the opposite ends of tube 84 limit this longitudinal movement in a shock absorbing manner.

The pivotal movement of arm 100 in the direction of arrows 151 in FIG. 1 is provided by the following arrangement. The tube comprising the branch portion 140 of arm 100 is firmly but rotatably received in a circular recess 160 provided in the upper surface of body 152 of connecting means 150. A rod 162 extends longitudinally along and within tube 140 and has a threaded end which connects into the body 152 centrally of recess 162. The opposite end of rod 162 terminates in a formation 164 which engages a saddle structure 166 on the outer surface of tube 102. Accordingly, tightening of the rod secures the arm 100 in a selected rotational position, and loosening of the rod allows the arm to pivot or rotate about the axis in the direction of arrows 151 shown in FIG. 1. The tightening and loosening of the rod is provided manually by means of a handle 168 shown in FIGS. 1 and 2 extending from formation 164.

As mentioned above, the apparatus of the present invention further comprises releasable holding means generally designated 180 in FIG. 2 for holding the support arm 100 in a selected or predetermined orientation along the plane of pivotal movement shown in FIG. 2 and for limiting the degree of this pivotal movement of arm 100. The holding means 180 also guides the support arm 100 during the longitudinal movement of arm 100 along guide arm 84 shown in FIG. 1. Referring now to FIGS. 10–13, the holding means 180 comprises a pair of operator elements in the form of rollers 182,184 located substantially on opposite sides of the auxiliary arm 94 for movement into and out of engagement with arm 94. Rollers 182,184 are of rubber, soft plastic or similar material for providing an effective gripping engagment with the outer surface of tube 94 and for having a good rolling and guiding contact with the surface of tube 94.

The holding means 180 also comprises operator means in the form of a mechanism or arrangement generally designated 188 carried by support arm 100 and connected to the rollers 182,184 for moving them into engagement with the auxiliary arm 94 thereby holding the support arm 100 in a selected or predetermined orientation and for moving the rollers 182,184 out of engagement with tube 94 thereby allowing pivotal movement of support arm 100. In particular, rollers 182 and 184 are rotatably connected to the ends of corresponding elongated arms 192 and 194, respectively, by pins 196 and 198. The axes of rotation of rollers 182,184 are substantially parallel to the longitudinal axes of the corresponding arms 192,194. The opposite ends of arms 192,194 are pivotally connected to the outer body or housing 152 of connecting means 150 and the pivot axes at these ends are substantially parallel to the longitudinal axis of the tubes 84 and 94. In particular, one side surface of housing 152, i.e. the left-hand side as viewed in FIGS. 10 and 12, is provided with a pair of closely spaced, parallel and relatively short arms 200,202 fixed to the side and extending therefrom. The end of arm 192 is received closely but movably between arms 200,202 and pivotally connected to the arms 200,202 by a pin 204. Similarly, the opposite side surface of housing 152, i.e. the right-hand side as viewed in FIGS. 11 and 12, is provided with a pair of closely spaced parallel and relatively short arms 206,208 fixed to the side and extending therefrom. Arm 194 is received closely but movably therebetween and pivotally connected thereto by pin 210.

As shown in FIGS. 10 and 11, each arm 192,194 is provided with a formation on the end near housing 152 which cooperates with the corresponding surface of the housing to limit the degree of pivotal movement of the arm. This, in turn, limits the degree of pivotal movement of support arm 100 in the direction shown in FIG. 2 as will be described. Arm 192 is provided with a surface 212 leading from the end and at an angle to the longitudinal axis thereof. Similarly, arm 194 is provided with a surface 214 leading from the end and at an angle to the longitudinal axis thereof. The angular orientations of surfaces 212,214 with respect to the longitudinal axes of the corresponding arms 192,194 together with the location of the surfaces 212,214 with respect to the ends of the corresponding arms determine the maximum angle through which each arm can be pivoted as shown in FIGS. 10 and 11. In particular, as shown in FIG. 10, surfaces 212 and 214 are in contact with the side surfaces of housing 152 and arms 192,194 therefore are restrained from any further outward pivotal movement. This is the one limit of the extent of pivotal movement of arms 192,194. As shown in FIG. 11, surfaces 212 and 214 are spaced from the surface of housing 152 and the arms 192,194 are at the other extent or limit of the angular movement.

Arms 192,194 are pivoted or moved between the two limits shown in FIGS. 10 and 11 by a manually operated toggle mechanism as follows. A rod 218 is pivotally connected at one end to arm 192 by means of a block 222 having an internal bore through which one end of rod 218 extends. An adjustable connection of rod 218 to the block is provided by nuts 224 threaded on the end of the rod and engaging opposite faces of block 222. The block 222 is pivotally connected to arm 192 through a pin 226. The pivot axis is substantially parallel to the pivot axis of arm 192 at pin 204.

The other end of rod 218, i.e. the right-hand end as viewed in the drawings, is slidably received in a through bore of another block 230 which is pivotally connected to arm 194 by a pin 232. The pivot axis is substantially parallel to the axis defined by pin 20. The end of rod 218 extending outwardly beyond the block 230, i.e. the far right-hand end as viewed in the drawings, is pivotally connected to a bell crank lever associated with a handle 236. In particular, a pair of arms, one designated 240 in FIG. 12, extend from the end of handle 236. These two arms meet a pair of arms 242,244 at right angles. The arms 242,244 are pivotally connected by a pin 248 to the end of rod 218. The right angle junction of the bell crank arms is pivotally connected through pins 250,252 to a pair of links 254,256 which are connected to opposite sides of block 230 by pins 258 and 260. The links 254,256 are joined by a web 262.

With handle 236 in the position shown in FIG. 12 the rollers 182,184 are in the full open position and out of contact with tube 94 thereby allowing support arm 100 to pivot. When it is desired to move the rollers to the closed position of FIG. 11 to hold support arm 100 at a selected position, handle 236 is moved in a clockwise direction as viewed in FIG. 12 about the bell crank pivot defined by pins 250,252 to the position shown in FIG. 13. Rod 218 thus is moved to the right as viewed in the drawings and block 230 is moved to the left thereby placing the arrangement in the condition of FIG. 11.

FIGS. 7–9 show in further detail the connectin of yoke 106 to support arm 100. The open end of the support arm tube portion 104 is provided with an adapter block 270 secured in the tubular open end by fasteners 272. Block 270 extends out from the open end of the tube and has a planar, exposed surface 274. The threaded rod 113 is fixed to this extending portion and is disposed normal to surface 274. Yoke portion 110 is provided with a slot 276 extending from the end thereof and terminating in a countersunk surface portion 278. Connection of yoke 110 to arm 100 is provided by fitting the slot 276 onto the shank of rod 113 and tightening the components together by means of threaded knob 112.

FIG. *7a* illustrates an arrangement of facilitate transportation of the apparatus between the locations of use. The machine carried by arm 100, for example the machine 12, is removed from arm 100 along with yoke 106. Handle 168 is turned manually to loosen the connection of arm portion 104 to housing 152 allowing pivotal movement of arm 100 in the direction of arrows 151 in FIG. 1 to a position where the longitudinal axis of arm 100 and tubes 84,94 is substantially coincident. This places the threaded central bore of knob 112 in alignment with a threaded, rod-like fitting 280 extending from the top surface of carriage frame portion 56 and disposed at an angle. Knob 112 then is rotated further outwardly along rod 113 and threadably connected onto the fitting 280 as shown in FIG. *7a*. This holds the rod 100 in place. A corresponding fitting 282 is provided on carriage frame portion 76 to allow the foregoing connection to be made at either side of the carriage.

The apparatus shown in FIGS. 1–13 is operated in the following manner. It is placed on a cutting room table or other supporting surface like surface 14 shown in FIGS. 1–3. With the apparatus on the supporting surface as shown in FIGS. 1–3 the carriage components 40,42 are in straddling relation to the sheet material placed on surface 14 and positioned for longitudinal movement in opposite directions along the length of the surface 14. If support arm 100 is in the transporting position held by the arrangement as shown in FIG. *7a*, then knob 112 is turned to disconnect it from fitting 280, handle 168 is turned to allow pivotal movement of arm 100 in the direction of arrows 151 in FIG. 1 to a position crosswise of arm 84, preferably the solid line portion of FIG. 1, whereupon handle 168 is tightened to hold this position of support arm 100. Also, arm 100 should be in the orientation shown in solid lines in FIG. 2 where tube portion 140 is disposed substantially normal to the supporting surface 14. Arm 100 is held in this orientation by holding means 180 with handle 236 in the position shown in FIGS. 11 and 13 to place rollers 182,184 in gripping contact with auxiliary arm 94 as shown in FIGS. 11 and 13. Then machine 12 with yoke 106 connected thereto is moved into position toward support arm end 104 and yoke 106 is connected thereto as described in connection with FIGS. 7–9 and held firmly by tightening knob 112. An electrical power supply cord (not shown) leading from an outlet or other appropriate supply is connected to machine 12. Machine 12 is rotatably connected to yoke 106 by a disc-shaped element 286 carried by machine 12 disposed perpendicular to the desired rotational axis of machine 12 and rotatably received in a circular opening 288 in yoke portion 108, preferably journalled therein by a ring bearing (not shown).

As shown in FIGS. 1–4, with the apparatus being positioned ready for use, wheels **46*a*,46*b* engage track 32 and wheels 66*a*,66*b* contact surface 14. Among various cutting room tables or other supporting structures, there will be some variation between the upper surface of the track and the supporting surface on which the sheet material is placed. In order to compensate for these differences, the apparatus of the present invention includes means for adjusting the location of the carriage means relative to supporting surface 14 in a direction substantially perpendicular to surface 14. In particular, there is provided spacer means such as the spacer bars 292 and 294 connected to frame portion 44 by screws 296 and 298 respectively for movement upon loosening of screws 296,298 from a rest position as shown in FIGS. 1–4 extending longitudinally along the lower edge of frame 44 to a position extending laterally inwardly of frame 44 contacting supporting surface 14 as shown in FIG. 5 for spacing the carriage a predetermined distance, set by the thickness of bars 292,294 and their locations on frame 44, relative to supporting surface measured substantially perpendicular to surface 14. With spacers 292,294 in the position of FIG. 5, screws 52*a*,52*b* then are loosened to adjust the vertical location of wheels 46*a*,46*b* so that they properly engage track 32. Similarly, a pair of spacers 300,302 can be carried on frame 64 and upon loosening of screws such as screws 304 shown in FIG. 5 moved to position contacting surface 14 whereupon the screws fixing the location of wheels 66*a*,66*b*** are loosened to adjust these wheels also. When the foregoing adjustments are made, the spacers are returned to the rest position and held thereby tightening of the respective screws.

The amount of influence or effect of weight 120 carried on the end of support arm 100 opposite machine 12 can be adjusted by loosening knob 126 and sliding weight 120 outwardly along arm to increase the effect on machine 12 or inwardly to reduce the effect. When the desired location of weight 120 is reached, as determined by the user, it is maintained by tightening knob 126.

The apparatus 10 now is ready to support and guide machine 12 to operate on sheet material placed on surface 14. With the arrangement shown where machine 12 is a straight knife machine for cutting cloth, typically a stack of cloth sheets is placed on the cutting table. The user grasps handle 24, turns machine 12 on, and proceeds to move the machine by pushing, turning and pulling along an indicated pattern or path. In particular, assume arm 100 is in the solid line position shown in FIG. 1. The pivotal connection of machine 12 to yoke 106 about the operating or cutting axis of machine 12 facilitates turning movements of machine 12 by manipulation through handle 24. Machine 12 is movable freely to the left and right as viewed in FIGS. 1 and 2 and is guided by the carriage movement in opposite directions along surface 14. Movement of machine 12 in a direction perpendicular to the foregoing, i.e. in a direction laterally across surface 14 between sides 26,28, is accommodated by movement of support arm 100 longitudinally along guide arm 84 through linear bearing 150. This movmement is guided by rollers 182,184 rotating and moving along the contact with the outer surface of the auxiliary arm or tube 94. The inclination of support arm portion 102 between machine 12 and arm portion 140 provides a clearance space to accommodate movements of the arm, particularly the elbow, of the person using the apparatus to guide machine 12 during cutting or other operations. If the operator wishes to have machine 12 and rod 100 oriented at a different angle to tube 84 than that shown in solid lines in FIG. 1, handle 168 is turned to loosen arm portion 140, arm 100 pivoted in the direction of arrows 151 in FIG. 1, and handle 168 then tightened to fix the new orientation.

When machine 12 is cutting cloth near the end of supporting surface 14, this can be facilitated by adjusting the distance between machine 12 and the carriage frames 44,64. This is accomplished by loosening knobs 60,80 individually and moving frames 44,64 toward or away from machine 12 to make the desired adjustment. If desired, the carriage can be provided with a brake or suitable wheel lock preferably carried by either or both of the frames 44,64. When it is desired to have machine 12 operating on the left-hand side of arm 84 as viewed in FIGS. 1 and 2, handle 168 is loosened, arm 100 is pivoted in the direction of arrows 151 in FIG. 1 through an angle 180° and the handle 168 is tightened to maintain this orientation. The operator then proceeds to move machine 12 along the sheet material as explained above.

When some maintenance or minor repair must be performed as machine 12, for example changing the knife blade, the operator simply releases the holding or clamping means 180 by moving handle 236 to the position of FIGS. 10 and 12 to move rollers 182,184 out from tube 94 and then pivots support arm 100 to the broken line position of FIG. 2 thereby elevating machine 12 from surface 14. This pivoting of arm 100 is assisted by the influence of weight 120, and arm 100 with machine 12 on the one end is maintained in the broken line position of FIG. 2 by the weight on the opposite end. One of the rollers 182,184 in this instance roller 184 is in contact with the surface or auxiliary arm 94 to limit the pivotal movement of support arm 100. Machine 12 can be provided with a tilt responsive control 310 such as a mercury switch for disconnecting electrical power from machine 12 when in the tilted and elevated position shown in FIG. 2. Then maintenance or repair can be performed on machine 12 without the need to disconnect it from support arm 100 thereby reducing maintenance effort and time. The apparatus thereafter is returned to a position of use by grasping support arm 100 and pivoting it to the solid line position of FIG. 2, locking holding means 180 by moving handle 236 to the position of FIGS. 11 and 13, and then proceeding with use of machine 12 as described above.

The same pivoting of support arm 100 can be performed to reposition machine 12 anywhere on surface 14. When in the broken line position of FIG. 2, arm 100 can be moved longitudinally along guide arm 84, and it can be pivoted in the direction of arrows 151 in FIG. 1 upon releasing of handle 168. In situations where weight 120 is not employed, support arm 100 is kept in the solid line position of FIG. 2 and is movable longitudinally along guide arm 84 and pivotally movable in the direction of arrows 151 in FIG. 1.

The apparatus of the present invention has a number of advantages. The number of various movements described above in several adjustment capabilities enable the apparatus to allow a high degree of mobility in supporting and guiding machine 12 both while operating on the sheet material and for repositioning machine 12 anywhere on surface 14. The provision of the adjustable weight on arm 100 enables the operator to control the amount of operating machine weight on surface 14 and to reduce friction and minimize resistance during operation of machine 12 on the sheet material. The fact that arm 100 is effectively maintained in the rigid upright position shown in solid lines in FIG. 2 by the provision of holding means 180 provides consistent accuracy in cutting sheet material from top to bottom ply. In addition, the apparatus allows sharp turns to be made with machine 12 thereby resulting in tighter cuts.

The pivotal movement of arm 100 shown in FIG. 2 facilitates repositioning of machine 12 anywhere on surface 14 in conjunction with the other movement capabilities of the apparatus. This pivoted movement of arm 100 also advantageously allows repair and maintenance operations, such as changing of cutting blades or drill bits, to be performed on the machine 12 while connected to the apparatus.

The apparatus advantageously is relatively light in weight so as to be convenient and easy to use, maintain and transport. By way of example, in an illustrative machine made substantially entirely with aluminum parts, where the lengths of tubes 94,84 and the overall length of arm 100 is slightly less than six feet, with the outer diameters of tubes 84,94 and 102 being about 1½ inch to 2 inches, with frame portions 44,64 each being about 2 feet long and 4 inches wide, and with frame parts 56,76 having top edges located about 15 inches above surface 14, the overall weight of such illustrative apparatus is about 72 pounds with machine 12 and weight 120 removed.

In addition, the apparatus of the present invention is readily usable on existing work tables of various types, and the convenience, ease and effectiveness in operation of the apparatus reduces by years the level of human operator experience for cloth cutting.

FIG. 14 shows an arrangement according to another embodiment of the present invention where the weight on the end of support arm 100 is provided by another machine which also operates on the sheet material. In FIG. 14 components identical to the apparatus of FIGS. 1–13 are identified by the same reference numerals with a prime designation. In the arrangement of FIG. 14 the other machine is a cloth drill generally designated 316. By way of example, drill 316 can be a cloth drill machine commercially available from Eastman Machine Company designated model CD3 with the supporting base removed. Support arm 100' is provided at the end opposite machine 12' with an end section 320 substantially identical to section 104' and provided with an adapter 322 identical to adapter 270'. The standard or frame 324 of drill 316 is fixed to a yoke 326 which is identical to yoke 106'. Yoke 326 is connected to arm portion 320 by means including knob 330 in a manner identical to the connection of yoke 106' to arm section 104' as shown and described also in connection with FIGS. 7–9. In the arrangement of FIG. 14, machine 12' and 316 are of approximately the same weight and serve as connector balancing weights for each other between the two pivoted positions of arm 100' shown in FIG. 14.

The apparatus of the present invention also can be provided with visual level condition indicating means for the machine supported and guided by the apparatus. The level indicating means is in the form of a conventional bull's eye liquid level designated 334 and shown for convenience in FIG. 14 on yokes 116' and yoke 326. It can be employed also in the form of the apparatus shown in FIGS. 1–13 as illstrated in FIG. 17 which shows yoke 106 in further detail.

In accordance with the present invention an improved supporting base can be provided on the machine which is guided and supported by apparatus 10 of the present invention. For convenience in illustration, the improved supporting base, generally designated 320, is shown in FIG. 14 installed on machine 12'. Supporting base 340 also could be used in place of base 20 in an arrangement of FIGS. 1–13. In addition, supporting base 340 can be used with machines guided and supported by other arrangements which include at least one arm extending over the work surface coupled at one end to the machine for guiding and supporting the same and coupled at the other end to some form of supporting structure, typically a carriage associated with at least one side of the work surface.

Supporting base 340 is shown in greater detail in FIGS. 15 and 16 and comprises a sheet 342 of resilient material in the form of spring metal which is generally rectangular in outline as viewed in FIG. 15 having a pair of straight substantially parallel side edges 344,346 and a pair of outwardly curved or convex end edges 348 and 350. As viewed in FIGS. 15 and 16, edge 350 is the leading edge which faces in the direction of forward machine travel and edge 348 is the trailing edge. The sheet 342 includes a portion 352 adjacent trailing edge 348 which is adapted to contact the work supporting surface such as surface 14' as the machine is moved therealong. The trailing edge portion 352 is shaped in a manner such that the rearward facing edge 348 is spaced from the surface to facilitate movement of sheet 342 over and along the surface with reduced friction or drag. Trailing edge portion 352 is outwardly curved or convex in a direction facing the work supporting surface.

Sheet 342 also includes a portion 354 adjacent leading edge 350 which is adapted to contact the supporting surface as the machine is moved therealong. The trailing edge portion 354 is flat, planar and disposed in a plane substantially perpendicular to the operating axis of the machine, i.e. the machine axis along which the tool such as cutting blade or drill bit is moved when operating on the material. Portion 354 moves under the material to be cut to guide it over the top surface of sheet 342. Sheet 342 further includes an intermediate portion 356 between the trailing and leading edge portions 352 and 354, respectively, which is shaped to be spaced from the work supporting surface as the machine is moved therealong. As shown in FIG. 16, intermediate portion 356 is arched or curved inwardly or concave in a direction facing the work supporting surface.

Intermediate portion 356 is provided with an opening to receive the tool of the machine for operating movement and has means for connecting the base 340 to the frame or support of the machine. When base 340 is used with a straight knife machine designated 12 or 12' in FIGS. 1–14, portion 356 is provided with a slot-like opening 360 disposed parallel to side edges 344,346 for receiving threthrough the machine cutting blade 362. Blade 362 is guided by a machine standard or frame component 364 which is secured to portion 356 by a fastener 366. The afore-mentioned machine axis is parallel to the longitudinal axis of blade 362 and standard 364. During forward movement, leading edge 350 and portion 354 move under the sheet material to be cut guiding it over and along the upward facing surface of portion 356 toward blade 362. Blade 362 is illustrated in FIG. 16 in its lowermost position of operation. In an extreme case of deflection of portion 356, the head of fastener 366 acts as a stop to prevent blade 362 from damaging the work surface 14'.

Base 340 is small in size, light in weight, relatively economical to manufacture and effective in operation. The streamlined shape and size of base 340 results in a significant reduction in cloth cutting resistance. The small size of base 340 allows relatively close cutting, for example the ability to cut $1\frac{1}{4}$ inch of the needles in plaid or striped material when the overall dimension of base 340 are $2\frac{1}{2}$ inch square.

By way of example, in an illustrative base, sheet 342 is 1090 cold rolled steel which is heat treated to provide its spring qualities and which is about 0.030 inch thick. The width of sheet 342 measured between sides 344,346 is about 1.125 inch, and the length of intermediate portion 356 is about 2.50 inches. The distance between the outermost point on edge 348 and the beginning of intermediate portion 356 is about 0.12 inch, and the distance between the outermost portion on edge 350 and the beginning of intermediate portion 356 is about 0.56 inch. The distance between the peak of portion 356 on the surface facing the machine and a plane coincident with the surface of leading edge portion 354 facing the material or supporting surface is about 0.37 inch, The curvature of intermediate portion 356 is that of the arc of a circle having a radius of about 2.5 inches.

It is therefore apparent that the present invention accomplishes its intended objects. While embodiments of the present invention have been described in detail, this is done for the purpose of illustration, not limitation.

We claim:

1. Apparatus for supporting and guiding a machine for operating on sheet material such as cloth while said material lies on a surface of a supporting structure having a pair of substantially parallel sides extending lengthwise of said supporting structure, said apparatus comprising:

(a) carriage means adapted for movement lengthwise of said supporting structure along a path substantially parallel to said sides;

(b) a guide arm having a longitudinal axis and carried by said carriage means and extending in a direction across said surface and between said sides and located in spaced relation to said supporting surface;

(c) a support arm having a longitudinal axis extending at an angle to said guide arm and located in spaced relation to said supporting surface said support arm having one end and means at said one end for carrying a machine for operating on said sheet material and said support are having another end, said ends of said support arm being located on opposite sides of and spaced from said guide arm; and (d) means for connecting said support arm to said guide arm, said connecting means including means for allowing pivotal movement of said support arm about an axis substantially parallel to said longitudinal axis of said guide arm and along a plane disposed substantially perpendicular to said supporting surface between a position where said one end of said support arm is nearest said supporting surface when said machine is operating on said sheet material and said support arm is inclined upwardly with said other end of said support arm farthest from said supporting surface and a position where said one end of said support arm is farthest from said supporting surface when said machine is raised from said surface and not operating on said sheet material and said support arm is inclined downwardly with said other end of said support arm nearest said supporting surface.

2. Apparatus according to claim 1, wherein said connecting means includes means for allowing longitudinal movement of said support arm along said guide arm.

3. Apparatus according to claim 1, wherein said connecting means includes means for allowing pivotal movement of said support arm about an axis substantially perpendicular to said longitudinal axis of said guide arm.

4. Apparatus according to claim 1, further including means operatively associated with said support arm for limiting the degree of pivotal movement of said support arm along said plane.

5. Apparatus according to claim 1, wherein said connecting means includes means for allowing removal of said connecting means from said guide arm.

6. Apparatus according to claim 1, wherein said connecting means includes means for allowing disconnection of said support arm therefrom.

7. Apparatus according to claim 1 further including a weight on said other end of said support arm for balancing the weight of the machine carried on the other end of said support arm during pivotal movement of said support arm along said plane.

8. Apparatus according to claim 7, wherein said weight is adjustable.

9. Apparatus according to claim 7, wherein said weight is slidably carried on said other end of said support arm, and further including releasable means for selectably fixing the location of said weight on said arm thereby permitting adjustment thereof.

10. Apparatus according to claim 1, further including tilt responsive control means operatively associated with said support arm for connection in controlling relation to a machine carried by said support arm for stopping said machine after a predetermined degree of pivotal movement of said support arm along said plane.

11. Apparatus according to claim 1, further including means operatively associated with said guide arm for adjusting the distance between said guide arm and said supporting surface.

12. Apparatus according to claim 1, further including means operatively associated with said support arm for adjusting the distance between said support arm and said supporting surface.

13. Apparatus according to claim 1, wherein said means on said support arm for carrying said machine includes means for allowing pivotal movement of said machine about an axis substantially perpendicular to the operating axis of said machine.

14. Apparatus according to claim 1, wherein said means on said support arm for carrying said machine comprises a yoke having a main body portion connected to said machine and another body portion removably connected to said support arm.

15. Apparatus according to claim 14, further including bearing means for pivotally connecting said machine to said yoke main body for allowing pivotal movement of said machine about an axis substantially parallel to the operating axis of said machine.

16. Apparatus according to claim 1, further including means at said other end of said support arm for carrying another machine for operating on said sheet material.

17. Apparatus according to claim 16, wherein said means at said other end of said support arm for carrying said other machine includes means for allowing pivotal movement of said other machine about an axis substantially perpendicular to the longitudinal axis of said support arm.

18. Apparatus according to claim 3, wherein said pivotal connecting means includes means for locking said support arm in a selected position after said pivotal movement.

19. Apparatus according to claim 1 wherein said carriage means comprises a frame extending lengthwise of said supporting structure and a pair of wheels rotatably connected to said frame at spaced locations along the length thereof.

20. Apparatus according to claim 19 wherein said carriage means comprises a pair of said frames one adjacent each side of said supporting structure each extending lengthwise of said supporting structure and a pair of wheels rotatably connected to each frame at spaced locations therealong.

21. Apparatus according to claim 19 further including means for adjusting the location of said carriage means relative to said supporting surface in a direction substantially perpendicular to said supporting surface.

22. Apparatus according to claim 1, further including releasable holding means for holding said support arm in a predetermined orientation along said plane.

23. Apparatus according to claim 22, further including means defining a guiding surface extending substantially parallel to said guide arm, said holding means including means operatively contacting said guiding surface for guiding said support arm during longitudinal movement along said guide arm.

24. Apparatus according to claim 22, wherein said holding means includes means for limiting the degree of movement of said support arm along said plane.

25. Apparatus for supporting and guiding a machine for operating on sheet material such as cloth while said material lies on a surface of a supporting structure having a pair of substantially parallel sides extending lengthwise of said supporting structure, said apparatus comprising:

(a) carriage means adapted for movement lengthwise of said supporting structure along a path substantially parallel to said sides, said carriage means comprising a frame extending lengthwise of said supporting structure and a pair of wheels rotatably connected to said frame at spaced locations along the length thereof, said wheels being adapted for engagement with guide means extending lengthwise of said supporting structure;

(b) a guide arm having a longitudinal axis and carried by said carriage means and extending in a direction across said surface and between said sides and located in spaced relation to said supporting surface;

(c) a support arm having a longitudinal axis extending at an angle to said guide arm and located in spaced relation to said supporting surface and having means at one end for carrying a machine for operating on said sheet material;

(d) means for connecting said support arm to said guide arm, said connecting means including means for allowing pivotal movement of said support arm about an axis substantially parallel to said longitudinal axis of said guide arm and along a plane disposed substantially perpendicular to said supporting surface;

(e) spacer means movably connected to said carriage means for movement between a rest position and a position contacting said supporting surface for spacing said carriage means a predetermined distance relative to said supporting surface measured substantially perpendicular to said supporting surface; and (f) means for adjusting the location of said rotatable connection of said wheels to said carriage means a predetermined distance relative to said supporting surface measured substantially perpendicular to said supporting surface;

(g) whereby said spacer means is moved into said contacting position, the location of said wheels is adjusted and then said spacer means returned to said rest position of said carriage means relative to said supporting surface.

26. Apparatus for supporting and guiding a machine for operating on sheet material such as cloth while said material lies on a surface of a supporting structure having a pair of substantially parallel sides extending lengthwise of said supporting structure, said apparatus comprising:

(a) carriage means adapted for movement lengthwise of said supporting structure along a path substantially parallel to said sides;

(b) a guide arm having a longitudinal axis and carried by said carriage means and extending in a direction across said surface and between said sides and located in spaced relation to said supporting surface;

(c) a support arm having a longitudinal axis extending at an angle to said guide arm and located in spaced relation to said supporting surface and having means at one end for carrying a machine for operating on said sheet material;

(d) means for connecting said support arm to said guide arm, said connecting means including means for allowing pivotal movement of said support arm about an axis substantially parallel to said longitudinal axis of said guide arm and along a plane disposed substantially perpendicular to said supporting surface;

(e) an auxiliary arm having a longitudinal axis and carried by said carriage means and extending substantially parallel to said guide arm;

(f) a pair of operator elements located substantially on opposite sides of said auxiliary arm for movement into and out of engagement with said arm; and (g) operator means carried by said support arm and connected to said operator elements for moving said elements into engagement with said auxiliary arm thereby holding said support arm in a predetermined orientation along said plane and for moving said elements out of engagement with said auxiliary arm thereby allowing pivotal movement of said support arm along said plane.

27. Apparatus according to claim 26, wherein said operator means includes manually operated means for causing said movements of said operator elements.

28. Apparatus according to claim 26, further including means for limiting the degree of movement of said operator elements out of engagement with said auxiliary arm thereby limiting the degree of movement of said support arm along said plane.

29. Apparatus according to claim 26, wherein said operator elements include means for guiding movement of said support arm longitudinally along said guide arm when said operator elements are in engagement with said auxiliary arm.

30. Apparatus according to claim 3, further including cooperating locking means on said guide arm and on said support arm for maintaining said arms in substantially parallel relation to facilitate transport of said apparatus.

31. Apparatus according to claim 1, further including a machine carried by said support arm at said one end, said machine comprising a frame, a tool positioned for movement relative to said frame and to said material for operating thereon and motor means carried by said frame and drivingly connected to said tool for causing operating movement thereof, and further including an improved supporting base for said machine for supporting said machine on supporting surface during movement over and along said surface while operating on said material, said improved supporting base comprising:

(a) a sheet of resilient material having a leading edge portion adapted to contact said supporting surface and facing in the direction of travel of said machine, a trailing edge portion adapted to contact said supporting surface, and an intermediate portion between said leading and trailing edge portions shaped to be spaced from said surface;

(b) said intermediate portion having an opening to receive said tool for operating movement and having means for connecting said sheet to said frame; and (c) said trailing edge portion being shaped in a manner such that the rearward edge thereof is spaced from said surface to facilitate movement of said sheet over and along said surface, and said leading edge being shaped to facilitate movement along said surface and under said material to guide said material over and along said sheet.

32. Apparatus for supporting and guiding a machine for operating on sheet material such as cloth while said material lies on a surface of a supporting structure having a pair of substantially parallel sides extending lengthwise of said supporting structure, said apparatus comprising:

(a) carriage means adapted for movement lengthwise of said supporting structure along a path substantially parallel to said sides;

(b) a guide arm having a longitudinal axis and carried by said carriage means and extending in a direction across said surface and between said sides and located in spaced relation to said supporting surface;

(c) a support arm having a longitudinal axis and located in spaced relation to said supporting surface and extending crosswise of said guide arm, said support arm having means at one end for carrying a machine for operating on said sheet material and means at the other end for carrying a balancing weight; and (d) means for connecting said support arm to said guide arm, said connecting means including means for allowing longitudinal movement of said support arm along said guide arm, means for allowing pivotal movement of said support arm about an axis substantially parallel to said longitudinal axis of said guide arm and along a plane disposed substantially perpendicular to said supporting surface between a position where said one end of said support arm is nearest said supporting surface when said machine is operating on said sheet material and said support arm is inclined upwardly with said other end of said support arm farthest from said supporting surface and a position where said one end of said support arm is farthest from said supporting surface when said machine is raised from said surface and not operating on said sheet material and said support arm is inclined downwardly with said other end of said support arm nearest said supporting surface.

33. In apparatus comprising a machine for operating on sheet material such as cloth during movement of said machine over and along said material while said material lies on a supporting surface and means for supporting and guiding said machine during said movement over and along said supporting surface, said machine comprising a frame, a tool positioned for movement relative to said frame and to said material for operating thereon and motor means carried by said frame and drivingly connected to said tool for causing operating movement thereof, an improved supporting base for said machine for supporting said machine on said supporting surface during movement over and along said surface, said improved supporting base comprising:

(a) a sheet of resilient material having a leading edge portion adapted to contact said supporting surface and facing in the direction of travel of said machine, a trailing edge portion adapted to contact said supporting surface, and an intermediate portion between said leading and trailing edge portions shaped to be spaced from said surface;

(b) said intermediate portion being curved in a concave manner facing said supporting surface and having an opening to receive said tool for operating movement and having means for connecting said sheet to said frame;

(c) said leading edge portion being shaped in a manner to facilitate movement along said supporting surface and under said material to guide said material over and along said sheet and said trailing edge portion being shaped in a manner such that the rearward edge thereof is spaced from said surface to facilitate movement of said sheet over and along said surface; and (d) said leading edge portions and said trailing edge portions providing the sole means of contact with said supporting surface and said base having a streamlined shape and size to reduce cutting resistance (e) said supporting and guiding means comprising carriage means movable relative to said supporting surface and at least one arm connected at one end to said machine and connected at the other end to said carriage means for pivotal movement about an axis generally parallel to said supporting surface and generally perpendicular to the longitudinal axis of said at least one arm and for translatory movement across said supporting surface.

34. Apparatus according to claim 33, wherein said sheet is of spring metal.

35. Apparatus according to claim 33, wherein said trailing edge portion is curved.

36. Apparatus according to claim 33, wherein said leading edge portion is flat.

37. Apparatus according to claim 33, wherein said supporting surface is on a supporting structure having a pair of substantially parallel sides extending lengthwise of said supporting structure and wherein said supporting and guiding means comprises at least one arm extending over said supporting surface coupled at one end to said machine and coupled at the other end to carriage means operatively associated with at least one of said sides of said supporting structure.

* * * * *